US007712464B2

(12) United States Patent
Lian

(10) Patent No.: US 7,712,464 B2
(45) Date of Patent: May 11, 2010

(54) VALVE FOR PAINT BALL GUNS

(75) Inventor: Sheng-Jen Lian, Taichung County (TW)

(73) Assignee: Yao-Gwo Gan, Taichung (TW)

( * ) Notice: Subject to any disclaimer, the term of this patent is extended or adjusted under 35 U.S.C. 154(b) by 16 days.

(21) Appl. No.: 12/155,408

(22) Filed: Jun. 4, 2008

(65) Prior Publication Data

US 2009/0301459 A1 Dec. 10, 2009

(51) Int. Cl.
*F41B 11/00* (2006.01)

(52) U.S. Cl. ..... 124/73; 124/70; 124/74; 124/75; 124/76; 124/77

(58) Field of Classification Search ..... 124/70, 124/73–77; 102/440; 251/39
See application file for complete search history.

(56) References Cited

U.S. PATENT DOCUMENTS

| | | | | | |
|---|---|---|---|---|---|
| 267,027 | A * | 11/1882 | Shaw | 124/69 |
| 1,658,000 | A * | 1/1928 | Langdon | 251/39 |
| 1,659,846 | A * | 2/1928 | Wagner | 251/39 |
| 3,088,440 | A * | 5/1963 | Wilmer | 91/5 |
| 3,240,200 | A * | 3/1966 | Jones | 124/75 |
| 3,910,222 | A * | 10/1975 | Metivier | 116/70 |
| 4,345,880 | A * | 8/1982 | Zanarini | 417/264 |
| 4,361,075 | A * | 11/1982 | Block | 91/420 |
| 4,936,282 | A * | 6/1990 | Dobbins et al. | 124/74 |
| 5,187,323 | A * | 2/1993 | Saxby | 102/440 |
| 5,265,582 | A * | 11/1993 | Bhogal | 124/73 |
| 5,275,540 | A * | 1/1994 | Brown | 417/404 |
| 5,307,714 | A * | 5/1994 | Muendlein et al. | 82/123 |
| 5,700,972 | A * | 12/1997 | Saxby | 102/440 |
| 5,954,043 | A * | 9/1999 | Mayville et al. | 124/75 |
| 5,962,805 | A * | 10/1999 | Saxby | 102/440 |
| 6,000,386 | A * | 12/1999 | Johnson et al. | 124/69 |
| 6,276,354 | B1 * | 8/2001 | Dillon | 124/74 |
| 6,314,954 | B1 * | 11/2001 | Wang | 124/74 |
| 7,258,138 | B2 * | 8/2007 | Carpenter et al. | 137/625.25 |
| 7,299,796 | B2 * | 11/2007 | Kirwan | 124/71 |
| 7,520,275 | B2 * | 4/2009 | Long | 124/73 |
| 7,527,049 | B2 * | 5/2009 | Sheng | 124/73 |
| 2007/0017406 | A1 * | 1/2007 | Tippmann, Jr. | 102/440 |
| 2007/0289586 | A1 * | 12/2007 | Tsurumoto | 124/73 |
| 2009/0178661 | A1 * | 7/2009 | Wood | 124/73 |

* cited by examiner

*Primary Examiner*—Troy Chambers
*Assistant Examiner*—Samir Abdosh

(57) ABSTRACT

A valve for paint ball guns includes a case for receiving a first piston rod therein in which a first end of a second piston rod is movably received. The case includes several chambers defined therein so as to introduce pressurized air into the barrel of the paint ball gun. The first piston rod includes two piston rings and one of which is larger than the other. The first piston rod is biased by a first spring. The first end of the second piston rod in the first piston rod is biased by a second spring which is easily overcome by pushing the second piston rod by a driving member. The movement of the second piston rod introduces pressurized air to apply to the piston ring of larger area to generate a force to overcome the force from the first spring and the piston ring of the smaller area.

11 Claims, 5 Drawing Sheets

VALVE FOR PAINT BALL GUNS

BACKGROUND OF THE INVENTION (1) Field of the Invention

The present invention relates to a paint ball gun, and more particularly, to a valve for a paint ball gun and the valve is operated with less force.

(2) Description of the Prior Art

A conventional paint ball gun generally includes a valve which includes a spring biasing a piston rod so as to seal passages to prevent the pressurized air from entering the barrel to shoot the paint balls when the trigger is not yet pulled. The piston rod includes a flange which is applied a force by the pressurized air so that when the trigger is pulled, the force that is used to move the piston rod has to overcome the combination force of the spring and the force from the pressurized air. In order to generate the sufficient force to move the piston rod, a significant amount of pressurized air is introduced to a space located at rear end of the driving member that pushes the piston rod. In other words, the pressurized air source has to dispense a certain amount of the pressurized therein to move the drive the driving member and this reduces the times of shooting.

The present invention intends to provide a valve for a paint ball gun and the valve includes a piston rod which has piston rings of different areas so that the piston rod can be moved with less force.

SUMMARY OF THE INVENTION

The present invention relates to a valve for paint ball guns and the valve comprises a case having a first chamber, a second chamber and a third chamber defined therein. An inlet communicating with the first chamber and an outlet communicating with the second chamber are respectively through a wall of the case. A first piston rod is a hollow and tubular member and received in the case. A first piston ring is mounted to the first piston rod and movable between a first position and a second position thereof. The first piston ring seals the communication between the first and second chambers when the first piston ring is in the first position. The first and second chambers are in communication with each other when the first piston ring is in the second position. A second position ring is connected to the first piston rod and separates the second and third chambers. A fourth chamber is defined in the first piston rod and communicates with the third chamber.

A second piston rod has a first end received in the first piston rod. An introduction hole is defined through a wall of the first piston rod and communicates with the fourth chamber. A third piston ring is connected to the second piston rod and located in the fourth chamber. The third piston ring is movable between a first position and a second position. The introduction hole is sealed by the third piston ring when the third piston ring is at the first position thereof. The introduction hole is opened by the third piston ring when the third piston ring is at the second position thereof. A driving member pushes a second end of the second piston rod to move the second piston rod from the first position to the second position thereof so that pressurized air in the first chamber enters into the fourth chamber and the third chamber via the introduction hole to move the first piston rod from the first position to the second position thereof.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
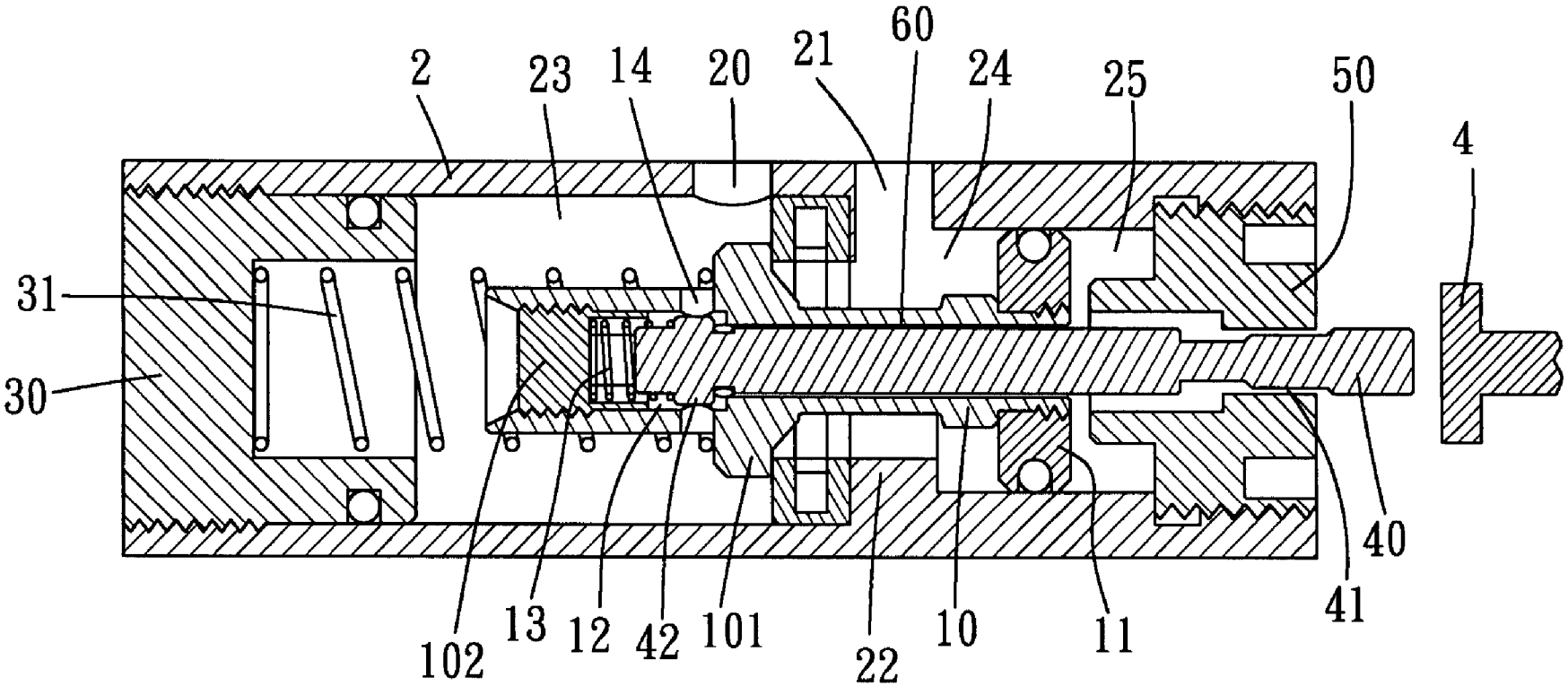
FIG. 1 is a side cross sectional view of the valve of the present invention.
Figure 2:
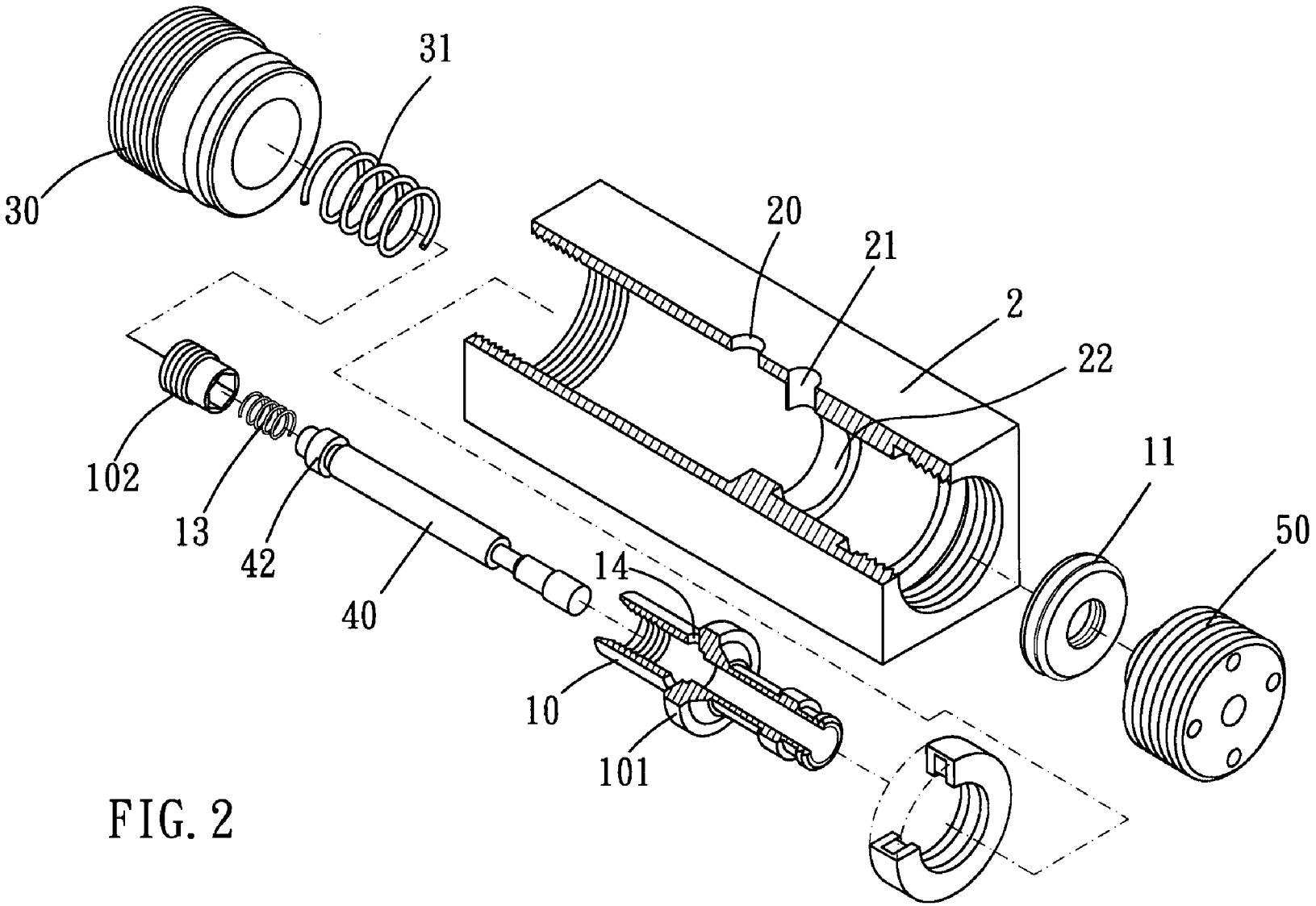
FIG. 2 is an exploded view to show the valve of the present invention.
Figure 5:
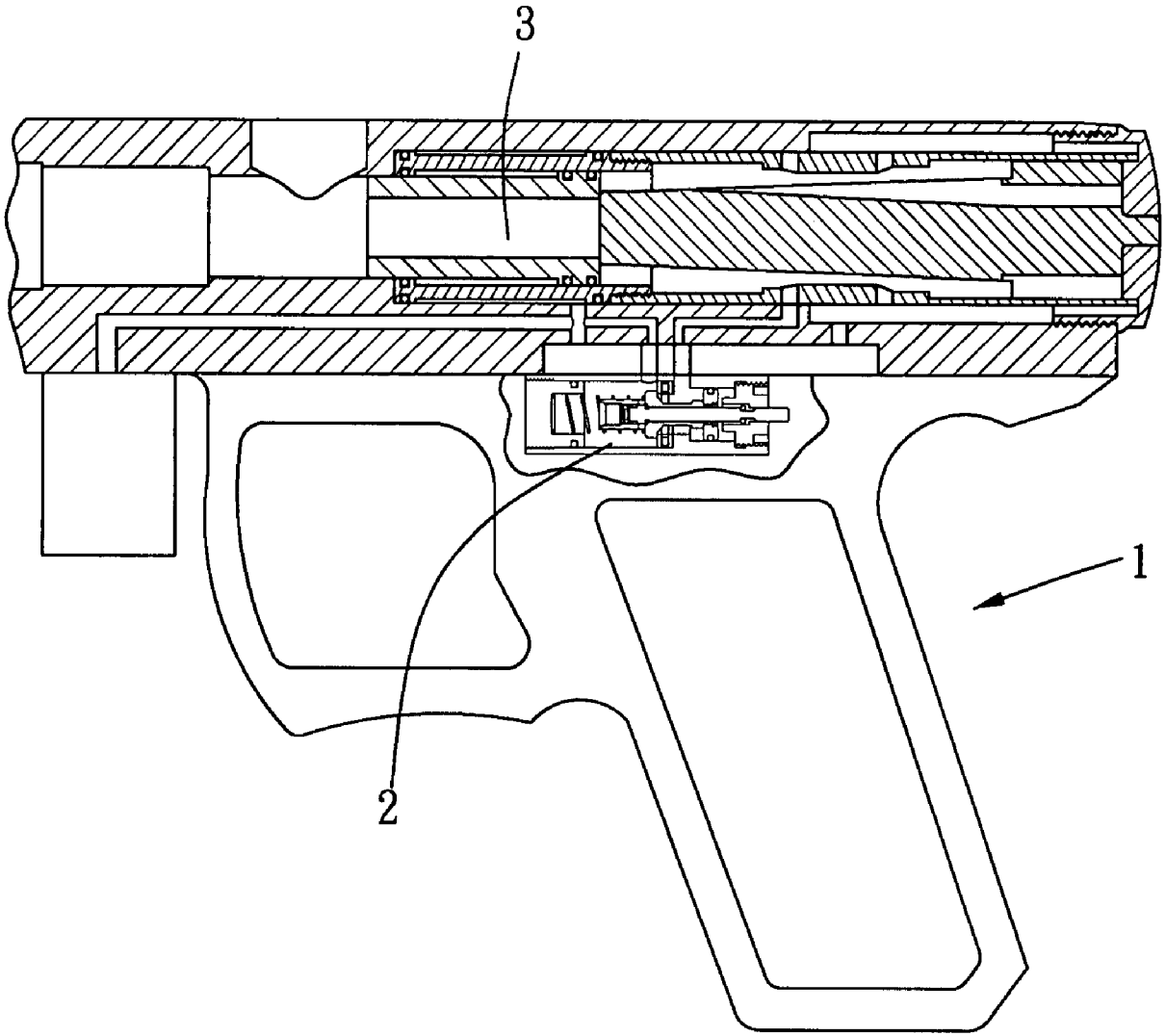
FIG. 5 is a partial cross sectional view to show that the valve of the present invention is installed to a paint ball gun.

Referring to FIGS. 1, 2 and 5, the paint ball gun 1 comprises a barrel 3 and the valve 2 of the present invention is located below the barrel 1. A handle is connected to the barrel 1 and a trigger (not shown) is connected to the handle so as to activate the valve 2. The valve 2 introduces pressurized air into the barrel 3 to shoot the paint balls (not shown) in the barrel 3.

The valve 2 for the paint ball gun 1 of the present invention comprises a case which includes two open ends and a first chamber 23, a second chamber 24 and a third chamber 25 are defined in the case. A flange 22 extends inward from the inner periphery of the case. An inlet 20 and an outlet 21 are respectively through a wall of the case 2. The inlet 20 communicates with the first chamber 23 and the outlet 21 communicates with the second chamber 24. A sealing member (not numbered) is connected to a side of the flange 22 and located between the inlet 20 and the outlet 21.

Figure 3:
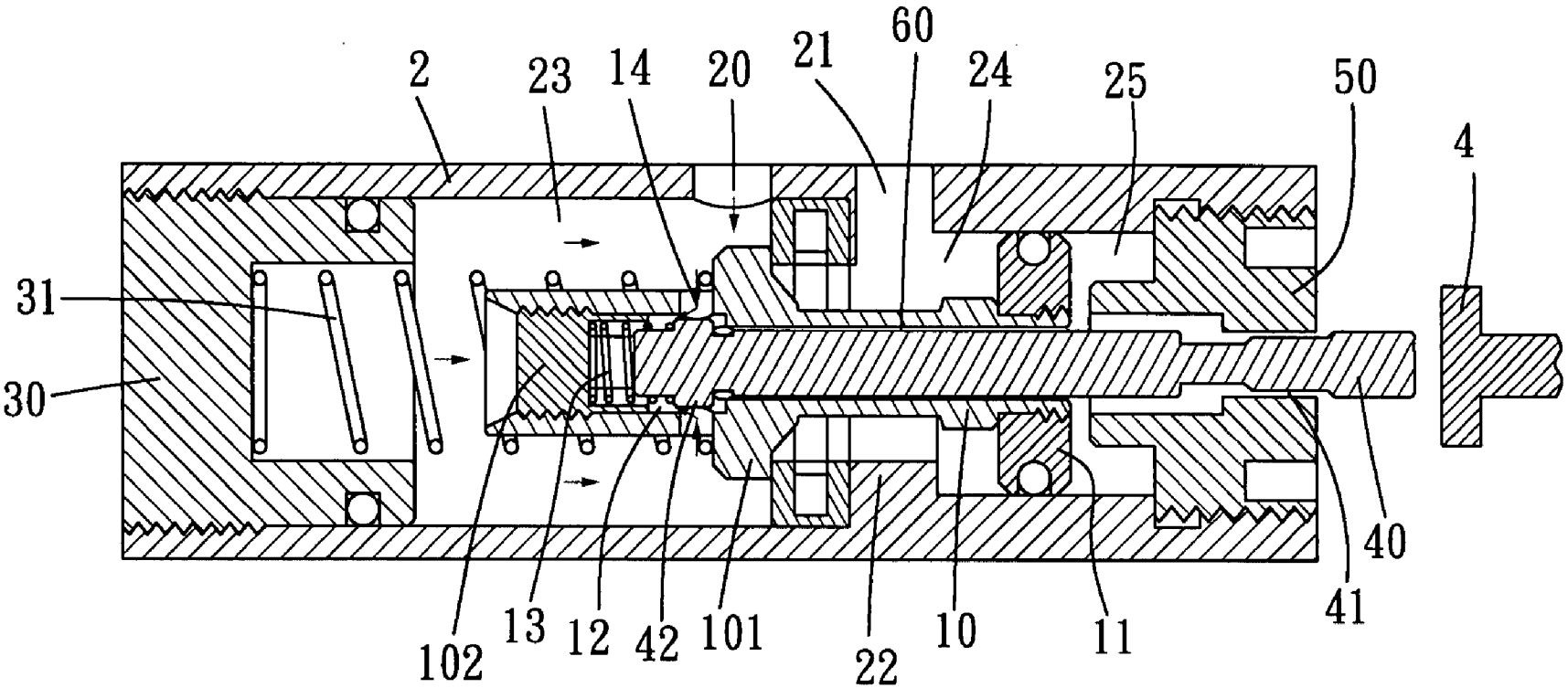
FIG. 3 is a side cross sectional view of the valve of the present invention, wherein pressurized air is filled in the first chamber.
Figure 4:
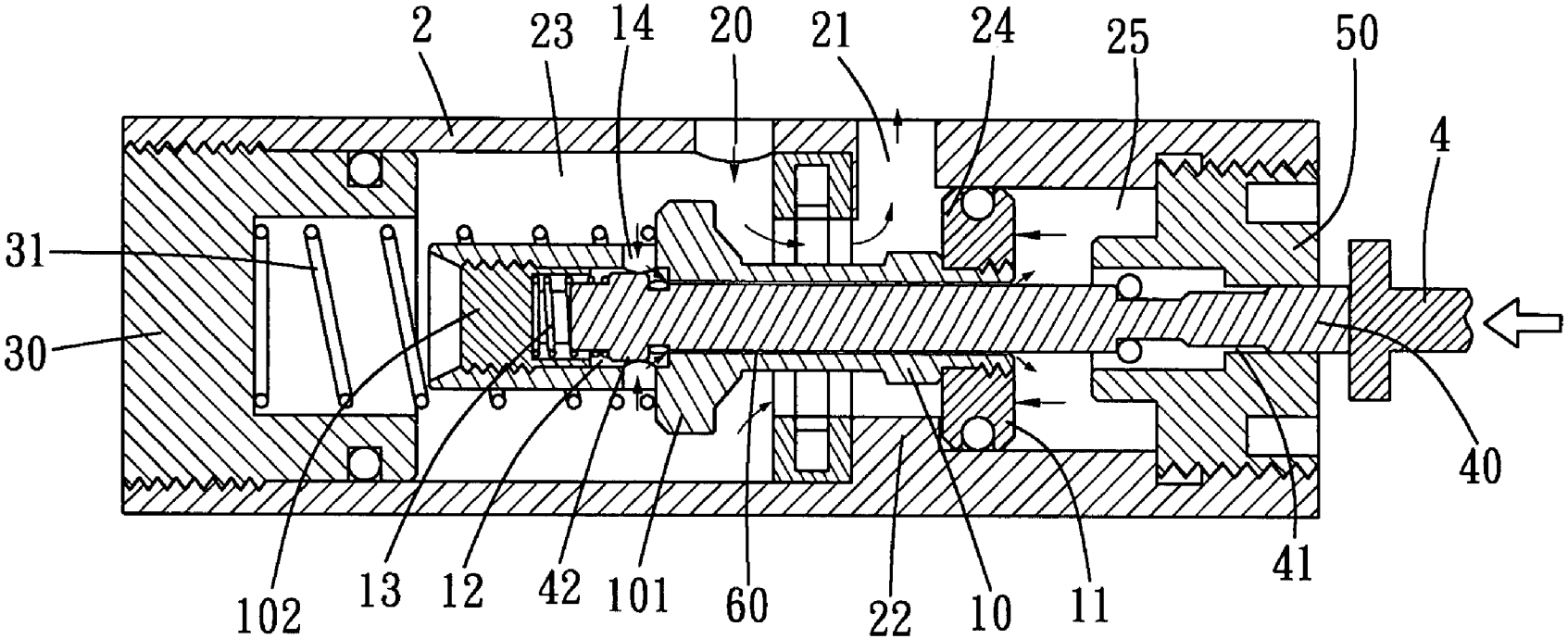
FIG. 4 is a side cross sectional view of the valve of the present invention, wherein pressurized air is filled in the first chamber, wherein the second piston rod is pushed and pressurized air releases from the outlet.

A hollow and tubular first piston rod 10 received in the case 2 and a first piston ring 101 is mounted to the first piston rod 10 and movable between a first position and a second position thereof. A second position ring 11 is connected to the first piston rod 10 and engaged with the inner periphery of the case so as to separate the second and third chambers 24, 25. An area of the second piston ring 11 is larger than that of an end surface of the first piston rod 10. The first piston ring 101 seals the communication between the first and second chambers 23, 24 when the first piston ring 101 is in the first position as shown in FIG. 3. The first and second chambers 23, 24 are in communication with each other when the first piston ring 101 is in the second position as shown in FIG. 4.

A fourth chamber 12 is defined in the first piston rod 10 and communicates with the third chamber 25 via an annular passage 60 defined between the inner periphery of the first piston rod 10 and a second piston rod 40 movably received in the first piston rod 10.

The second piston rod 40 has a first end received in the first piston rod 10. An introduction hole 14 is defined through a wall of the first piston rod 10 and communicates with the fourth chamber 12. A third piston ring 42 is connected to the second piston rod 40 and located in the fourth chamber 12. The third piston ring 42 is movable between a first position and a second position. The introduction hole 14 is sealed by the third piston ring 42 when the third piston ring 42 is at the first position thereof as shown in FIG. 3. The introduction hole 14 is opened by the third piston ring 42 when the third piston ring 42 is at the second position thereof as shown in FIG. 4.

An end cap 30 is engaged with and seals one of the two open ends. A spring 31 has one end contacting the end cap 30 and the other end of the spring 31 is mounted to the first piston rod 10 and biases the first piston ring 101. A ring-shaped member 50 is engaged with the other open end of the case 2 and the second end of the second piston rod 40 extends through the ring-shaped member 50. An annular passage 41 is defined between the second piston rod 40 and an inner periphery of the ring-shaped member 50. A second spring 13 is located in the fourth chamber 12 and biased between the third piston ring 42 and a fourth piston ring 102 engaged with an end of the first piston rod 10.

A driving member 4 is located corresponding to the second end of the second piston rod 40. As shown in FIG. 4, when the user pulls the trigger (not shown), the driving member 4 pushes the second end of the second piston rod 40 to move the second piston rod 40 from the first position to the second position thereof so that pressurized air in the first chamber 23 enters into the fourth chamber 12 and the third chamber 25 via the introduction hole 14 to move the first piston rod 10 from the first position to the second position thereof.

An area of the first piston rod 10 is larger than that of an end surface of the second piston rod 40, and an area of the second piston rod 40 in the fourth chamber 12 is 10% to 50% of an end surface of the first piston rod 10 in the first chamber 23. Therefore, when the second piston rod 40 is pushed by the driving member 4, the force from the driving member 4 overcomes the force of the second spring 13, the first piston ring 101 is moved to open the first and second chambers 23, 24, the pressurized air enters the second chamber 24 and goes through the outlet 21 and enters into the barrel 3 to shoot the paint ball in the barrel 3. Some of the pressurized air enters the introduction hole 14 and goes through the annular passage 60 and enters into the third chamber 25. The pressurized air applies to the second piston ring 11 and generates a force to overcome the force of the first spring 31 and the force applied to the end surface of the first piston rod 10, so that the first piston rod 10 can quickly move from the first position to the second position.

After shooting, the remained pressurized air in the third chamber 25 releases from the annular passage 41, the first and second springs 31, 13 push the first and second piston rods 10, 40 back to their original positions.

While we have shown and described the embodiment in accordance with the present invention, it should be clear to those skilled in the art that further embodiments may be made without departing from the scope of the present invention.

What is claimed is:

1. A valve for paint ball guns, comprising:

a case having a first chamber, a second chamber and a third chamber defined in the case, an inlet and an outlet respectively through a wall of the case, the inlet communicating with the first chamber and the outlet communicating with the second chamber;

a first piston rod being a hollow and tubular member and received in the case, a first piston ring mounted to the first piston rod and movable between a first position and a second position thereof, the first piston ring sealing communication between the first and second chambers when the first piston ring is in the first position, the first and second chambers being in communication with each other when the first piston ring is in the second position;

a second position ring connected to the first piston rod and separating the second and third chambers, a fourth chamber defined in the first piston rod and communicating with the third chamber;

a second piston rod having a first end received in the first piston rod, an introduction hole defined through a wall of the first piston rod and communicating with the fourth chamber, a third piston ring connected to the second piston rod and located in the fourth chamber, the third piston ring being movable between a first position and a second position, the introduction hole being sealed by the third piston ring when the third piston ring is at the first position thereof, the introduction hole being opened by the third piston ring when the third piston ring is at the second position thereof, and a driving member pushing a second end of the second piston rod to move the second piston rod from the first position to the second position thereof so that pressurized air in the first chamber enters into the fourth chamber and the third chamber via the introduction hole to move the first piston rod from the first position to the second position thereof.

2. The valve as claimed in claim 1, wherein the case includes two open ends and an end cap is engaged with and seals one of the two open ends, a spring has one end contacting the end cap and the other end of the spring is mounted to the first piston rod and biases the first piston ring, a ring-shaped member is engaged with the other open end of the case and the second end of the second piston rod extends through the ring-shaped member.

3. The valve as claimed in claim 2, wherein an annular passage is defined between the second piston rod and an inner periphery of the ring-shaped member.

4. The valve as claimed in claim 1, wherein an area of the second piston ring is larger than that of an end surface of the first piston rod, an area of the first piston rod is larger than that of an end surface of the second piston rod, an area of the second piston rod in the fourth chamber is 10% to 50% of an end surface of the first piston rod in the first chamber.

5. The valve as claimed in claim 1, wherein a second spring is located in the fourth chamber and biased between the third piston ring and a fourth piston ring engaged with an end of the first piston rod.

6. A paint ball gun comprising:

a barrel and a valve, the valve having a case which has a first chamber, a second chamber and a third chamber defined therein, an inlet and an outlet respectively through a wall of the case, the inlet communicating with the first chamber and the outlet communicating with the second chamber;

a first piston rod being a hollow and tubular member and received in the case, a first piston ring mounted to the first piston rod and movable between a first position and a second position thereof, the first piston ring sealing communication between the first and second chambers when the first piston ring is in the first position, the first and second chambers being in communication with each other when the first piston ring is in the second position;

a second position ring connected to the first piston rod and separating the second and third chambers, a fourth chamber defined in the first piston rod and communicating with the third chamber;

a second piston rod having a first end received in the first piston rod, an introduction hole defined through a wall of the first piston rod and communicating with the fourth chamber, a third piston ring connected to the second piston rod and located in the fourth chamber, the third piston ring being movable between a first position and a second position, the introduction hole being sealed by the third piston ring when the third piston ring is at the first position thereof, the introduction hole being opened by the third piston ring when the third piston ring is at the second position thereof, and a driving member pushing a second end of the second piston rod to move the second piston rod from the first position to the second position thereof so that pressurized air in the first chamber enters into the fourth chamber and the third chamber via the introduction hole to move the first piston rod from the first position to the second position thereof.

7. The valve as claimed in claim 6, wherein the barrel is located above the valve.

8. The valve as claimed in claim 6, wherein the case includes two open ends and an end cap is engaged with and seals one of the two open ends, a spring has one end contacting the end cap and the other end of the spring is mounted to the first piston rod and biases the first piston ring, a ring-shaped member is engaged with the other open end of the case and the second end of the second piston rod extends through the ring-shaped member.

9. The valve as claimed in claim 8, wherein an annular passage is defined between the second piston rod and an inner periphery of the ring-shaped member.

10. The valve as claimed in claim 6, wherein an area of the second piston ring is larger than that of an end surface of the first piston rod, an area of the first piston rod is larger than that of an end surface of the second piston rod, an area of the second piston rod in the fourth chamber is 10% to 50% of an end surface of the first piston rod in the first chamber.

11. The valve as claimed in claim 6, wherein a second spring is located in the fourth chamber and biased between the third piston ring and a fourth piston ring engaged with an end of the first piston rod.

* * * * *